US007303522B2

(12) United States Patent
Watanabe

(10) Patent No.: US 7,303,522 B2
(45) Date of Patent: Dec. 4, 2007

(54) PARALLEL FOLDING DEVICE OF FOLDING MACHINE

(75) Inventor: Takao Watanabe, Noda (JP)

(73) Assignee: Komori Corporation, Tokyo (JP)

( * ) Notice: Subject to any disclaimer, the term of this patent is extended or adjusted under 35 U.S.C. 154(b) by 47 days.

(21) Appl. No.: 11/116,370

(22) Filed: Apr. 28, 2005

(65) Prior Publication Data

US 2005/0245378 A1 Nov. 3, 2005

(30) Foreign Application Priority Data

Apr. 30, 2004 (JP) ..... 2004-136130

(51) Int. Cl.
*B31F 1/10* (2006.01)

(52) U.S. Cl. ..... 493/432; 493/424; 493/434; 493/442; 493/454

(58) Field of Classification Search ..... 493/424–428, 493/432, 434, 442, 454
See application file for complete search history.

(56) References Cited

U.S. PATENT DOCUMENTS 2,353,445 A * 7/1944 Crafts ..... 270/43
4,159,823 A * 7/1979 Bryer et al. ..... 493/369
5,065,993 A 11/1991 Reponty
5,096,174 A * 3/1992 Nishihara ..... 270/47
5,494,270 A 2/1996 Laubscher
5,522,586 A 6/1996 Bennett et al.

FOREIGN PATENT DOCUMENTS

JP 2002-60128 A 2/2002

* cited by examiner

*Primary Examiner*—Hemant M. Desai
(74) *Attorney, Agent, or Firm*—Birch, Stewart, Kolasch & Birch, LLP

(57) ABSTRACT

A parallel folding device includes: a folding cylinder which transfers a signature; a first jaw cylinder having gripper boards; an upper second jaw cylinder in contact with the first jaw cylinder and having grippers; a lower second jaw cylinder in contact with and the first jaw cylinder and having grippers; and a cam mechanism, which switches delivery channels between a channel in which the signature is transferred from the gripper boards of the first jaw cylinder to only the grippers of any one of the upper and lower second jaw cylinders, and in which the signature is transferred to the grippers of the upper second jaw cylinder and the grippers of the lower second jaw cylinder; and a channel which concurrently performs the changing of phases for causing the respective gripper boards to operate, from the first jaw cylinder to the upper second jaw cylinder and/or the lower jaw cylinder.

13 Claims, 12 Drawing Sheets

Fig. 6

| | | PNEUMATIC CYLINDER A | PNEUMATIC CYLINDER B | PNEUMATIC CYLINDER C | PNEUMATIC CYLINDER D |
|---|---|---|---|---|---|
| SINGLE FOLD | UPPER-AND-LOWER DISTRIBUTION DELIVERY | OFF | OFF | ON | OFF |
| | UPPER COMBINED DELIVERY | OFF | OFF | OFF | OFF |
| DOUBLE FOLD | UPPER-AND-LOWER DISTRIBUTION DELIVERY | ON | OFF | ON | ON |
| | UPPER COMBINED DELIVERY | ON | OFF | OFF | ON |
| DELTA FOLD | UPPER-AND-LOWER DISTRIBUTION DELIVERY | ON | ON | ON | OFF |
| | UPPER COMBINED DELIVERY | ON | ON | OFF | OFF |

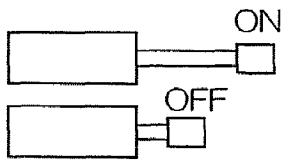

PARALLEL FOLDING DEVICE OF FOLDING MACHINE

CROSS REFERENCE TO RELATED APPLICATION

The entire disclosure of Japanese Patent Application No. 2004-136130 filed on Apr. 30, 2004, including specification, claims, drawings and summary, is incorporated herein by reference in its entirety.

BACKGROUND OF THE INVENTION

1. Field of the Invention

The present invention relates to a parallel folding device of a folding machine which can switch folding specifications and delivery modes for parallel folding operations at the same time.

2. Description of the Related Art

A web rotary printing press includes a folding machine which cuts, by a predetermined length, a web which has been dried and cooled after a printing operation, and which folds the web in the width direction or in the length direction.

There have been various structures for this type of folding machine. A folding machine including a parallel folding device, for example, as shown in FIG. 12 has been known (see Japanese Patent Laid-open Official Gazette No. 2002-60128).

This folding machine is provided with a parallel folding device 1 in a direction which makes a web W progress. The web W has been dried and cooled after a printing operation, and is guided into a paper inserting part of the folding machine. The parallel folding device 1 cuts and folds the web W by a predetermined dimension. The parallel folding device 1 includes a cutting cylinder 2, a folding cylinder 3 and a first jaw cylinder 4, all of which rotate in a direction as shown by an arrow in the figure.

The web W which has been sent into a space between the cutting cylinder 2 and the folding cylinder 3 is cut with a cutting blade, which is not illustrated, of the cutting cylinder 2 by the predetermined dimension. In addition, the web W is held with a pin, which is not illustrated, of the folding cylinder 3, and thereby is caused to wrap around a lower circumferential surface of the folding cylinder 3. The web thus cut, which is held with the pin, is subsequently gripped with gripper boards 5*a* to 5*d* of the first jaw cylinder 4 in cooperation with a sucker blade, which is not illustrated, of the folding cylinder (a number of gripper boards are provided in axis directions respectively of gripper board shafts 6*a* to 6*d* arranged in positions which quarter the circumferential surface). The cut web thus gripped is turned into a signature while being half-folded, and is caused to wrap around, and contact, the upper circumferential surface.

An upper second jaw cylinder 7 and a lower second jaw cylinder 8 are caused to be opposed to, and in contact with, each other downstream of the first jaw cylinder 4. An upper chopper folding device 9 is provided downstream of the upper second jaw cylinder 7. A lower chopper folding device 10 is provided downstream of the lower second jaw cylinder 8.

A number of gripper devices (hereinafter referred to as "grippers") 12*a* to 12*d* are provided in axis directions respectively of gripper shafts 11*a* to 11*d* arranged in positions which quarter the circumferential surface of the upper second jaw cylinder 7. A number of gripper devices (hereinafter referred to as "grippers") 14*b* and 14*d* are provided in axis directions respectively of gripper shafts 13*b* and 13*d* arranged in positions which bisect the circumferential surface of the lower second jaw cylinder 8. The grippers 12*a* to 12*d* of the upper second jaw cylinder 7 are sequentially caused to be opposed respectively to the gripper boards 5*a* to 5*d* of the first jaw cylinder 4. The grippers 14*b* and 14*d* of the lower second jaw cylinder 8 are designed to be opposed to only the gripper boards 5*b* and 5*d* of the first jaw cylinder 4 respectively. Incidentally, in FIG. 12, reference numeral 15 denotes a fan wheel for a delivering operation; and 16, a conveyer for the delivering operation.

In addition, the first jaw cylinder 4 is provided with a cam mechanism, which is not illustrated. A gripper opening cam causes the gripper boards 5*b* and 5*d* of the first jaw cylinder to open, the gripper boards 5*b* and 5*d* being assigned for the lower second jaw cylinder 8. If a phase of the gripper opening cam is changed or switched, the cam mechanism causes the gripper boards 5*a* to 5*d* to operate in a position which makes the folding cylinder 3 and the first jaw cylinder 4 opposed to, and in contact with, each other, and thereby causes the first jaw cylinder 4 to hold the signatures which have been transferred one by one. Thereafter, the cam mechanism can switch delivery operations between what is called an upper combined delivery and what is called an upper and lower distribution delivery. The upper combined delivery transfers the signatures from the gripper boards 5*a* to 5*d* of the first jaw cylinder 4 to only the grippers 12*a* to 12*d* of the upper second jaw cylinder 7. The upper-and-lower distribution delivery transfers the signatures from the gripper boards 5*a* to 5*d* of the first jaw cylinder 4 to the grippers 12*a* and 12*c* of the upper second jaw cylinder 7 as well as the grippers 14*b* and 14*d* of the lower second jaw cylinder 8.

Although the parallel folding device of the folding machine as disclosed in Japanese Patent Laid-open Official Gazette No. 2002-60128 can switch delivery operations between the upper combined delivery and the upper and lower distribution delivery, however, the parallel folding device of the folding machine has a disadvantage of being unable to switch folding operations between the following two folding specifications, since the gripper opening cam for opening the gripper boards 5*a* and 5*c* of the first jaw cylinder 4 for the upper second jaw cylinder 7 is fixed, or for similar reasons. One of the two folding specifications is a folding specification (a double folding and a delta folding) to fold the signatures between the first jaw cylinder 4 and the upper second jaw cylinder 7 and/or between the first jaw cylinder 4 and the lower second jaw cylinder 8 after a parallel folding operation. The other of the two folding specifications is a folding specification (a single folding) to fold no signature between the first jaw cylinder 4 and the upper second jaw cylinder 7 or between the first jaw cylinder 4 and the lower second jaw cylinder 8 after the parallel folding operation.

SUMMARY OF THE INVENTION

With this taken into consideration, an object of the present invention is to provide a parallel folding device of a folding machine which can switch both of folding specifications and delivery modes for parallel folding operations.

A parallel folding device of a folding machine according to the present invention includes a folding cylinder, a first jaw cylinder and two second jaw cylinders. The folding cylinder transfers a sheet. The first jaw cylinder includes gripping-holding means for gripping the sheet, which has been held by the folding cylinder, in a plurality of positions in the circumferential direction. One of the two second jaw cylinders is opposed to, and in contact with, the first jaw cylinder. This second jaw cylinder includes gripping-holding means for holding the sheet in a plurality of positions in the circumferential direction, and is rotatably supported. The other second jaw cylinder is opposed to, and in contact with, the first jaw cylinder. This second jaw cylinder includes gripping-holding means for holding the sheet, and is rotatably supported. The parallel folding device of a folding machine according to the present invention is characterized by further including switching means. The switching means switches delivery channels and folding specifications in the following manner after the gripping-holding means are operated in a position which makes the folding cylinder and the first jaw cylinder opposed to, and in contact with, each other, as well as after accordingly the first jaw cylinder is caused to hold the sheet thus transferred. With regard to the switching of the delivery channels, the switching means transfers the sheet from the gripping-holding means of the first jaw cylinder to only the gripping-holding means of the former second jaw cylinder, or from the gripping-holding means of the first jaw cylinder to the gripping-holding means of the former second jaw cylinder and the gripping-holding means of the latter second jaw cylinder. In each of the delivery channels, concurrently, the switching of the folding specifications is performed from the first jaw cylinder to the former second jaw cylinder and/or the latter second jaw cylinder.

In addition, in the parallel folding device of a folding machine according to the present invention, the gripping-holding means of the first jaw cylinder includes first gripping-holding means for supporting a first cam follower and second gripping-holding means for supporting a second cam follower. In the parallel folding device, the switching means includes a gripper closing cam fixed to a frame, and gripper opening cams for a first application and for a second application, both of which are movably supported by the frame. Furthermore in the parallel folding device, the first gripping-holding means operates in cooperation with the gripper closing cam, the gripper opening cam for the first application, and the first cam follower. Moreover, in the parallel folding device, the second gripping-holding means operates in cooperation with the gripper closing cam, the gripper opening cam for the second application, and the second cam follower.

Additionally, in the parallel folding device of a folding machine according to the present invention, the gripper opening cam for the first application is fixed to a rotating member, the gripper opening cam for the second application is caused by first drive means to move between the former second jaw cylinder and the latter second jaw cylinder, the first drive means is supported by a supporting member, the supporting member is fixed to the rotating member, and in the rotating member is rotated by second drive means.

In addition, in the parallel folding device of a folding machine according to the present invention, the second drive means includes two pneumatic cylinders connected in tandem.

BRIEF DESCRIPTION OF THE DRAWINGS

FIG. 6 is a diagram explaining how pneumatic cylinders operate for each delivery mode in each folding specifications, showing the embodiment of the present invention.

DETAILED DESCRIPTION OF THE INVENTION

Hereinafter, detailed descriptions will be provided for the parallel folding device of the folding machine according to the present invention, according to embodiments of the present invention, with reference to the drawings.

Figure 1:
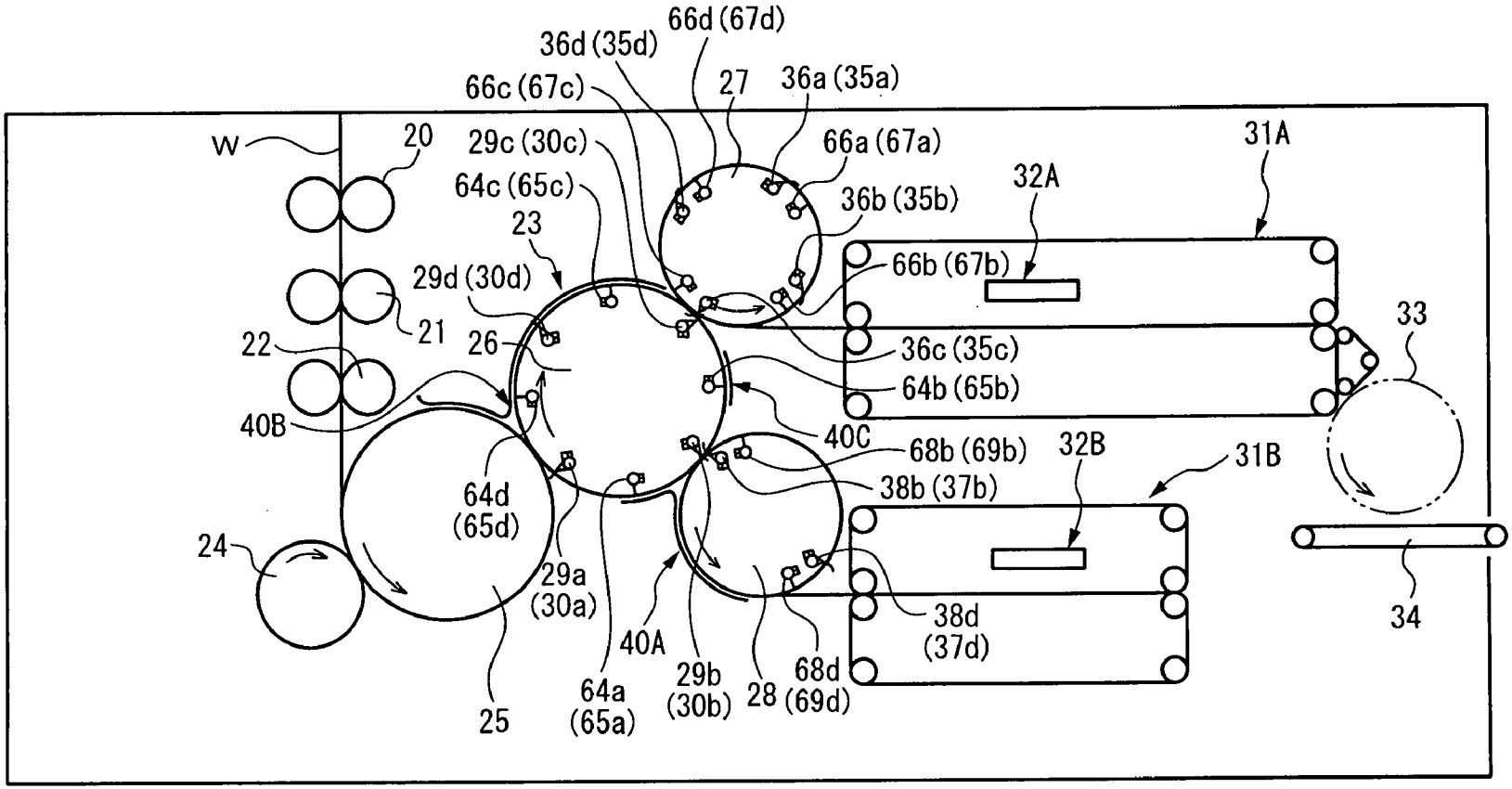
FIG. 1 is a schematic side view of a folding machine of a rotary printing press showing an embodiment of the present invention.
Figure 2:
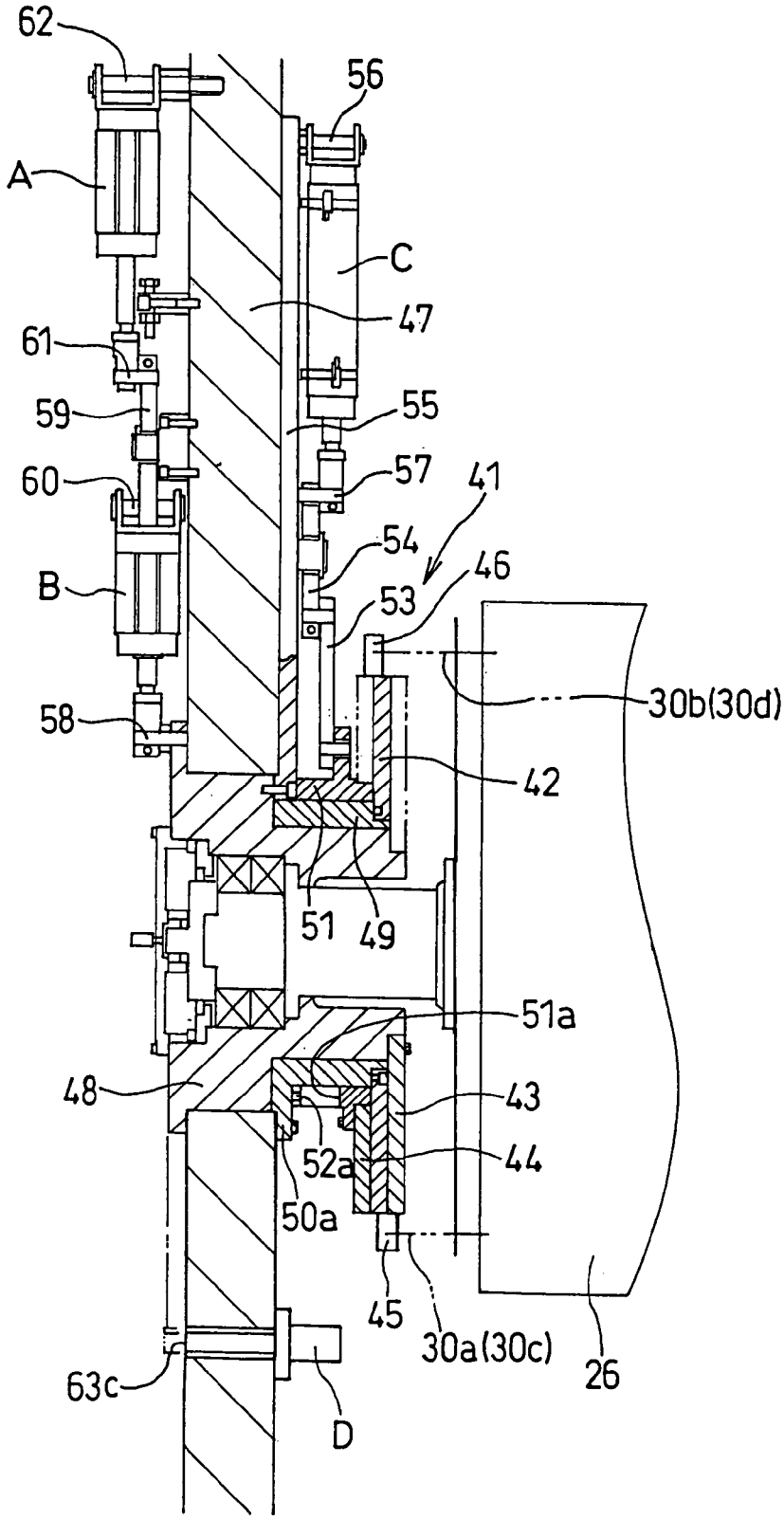
FIG. 2 is an explanatory diagram of a structure of a cam mechanism showing the embodiment of the present invention.
Figure 3:
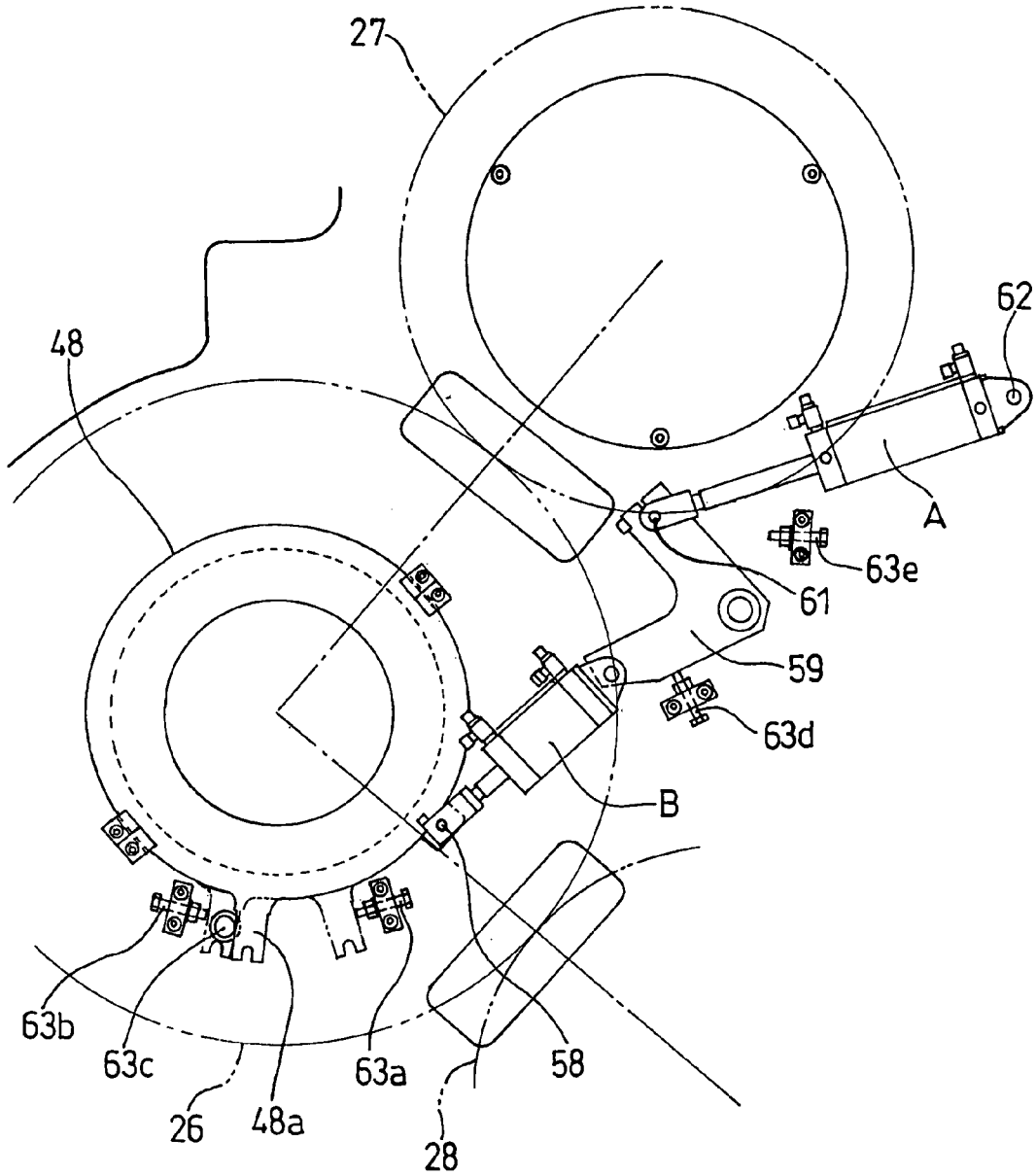
FIG. 3 is a view of FIG. 2 on the arrow A showing the embodiment of the present invention.
Figure 4:
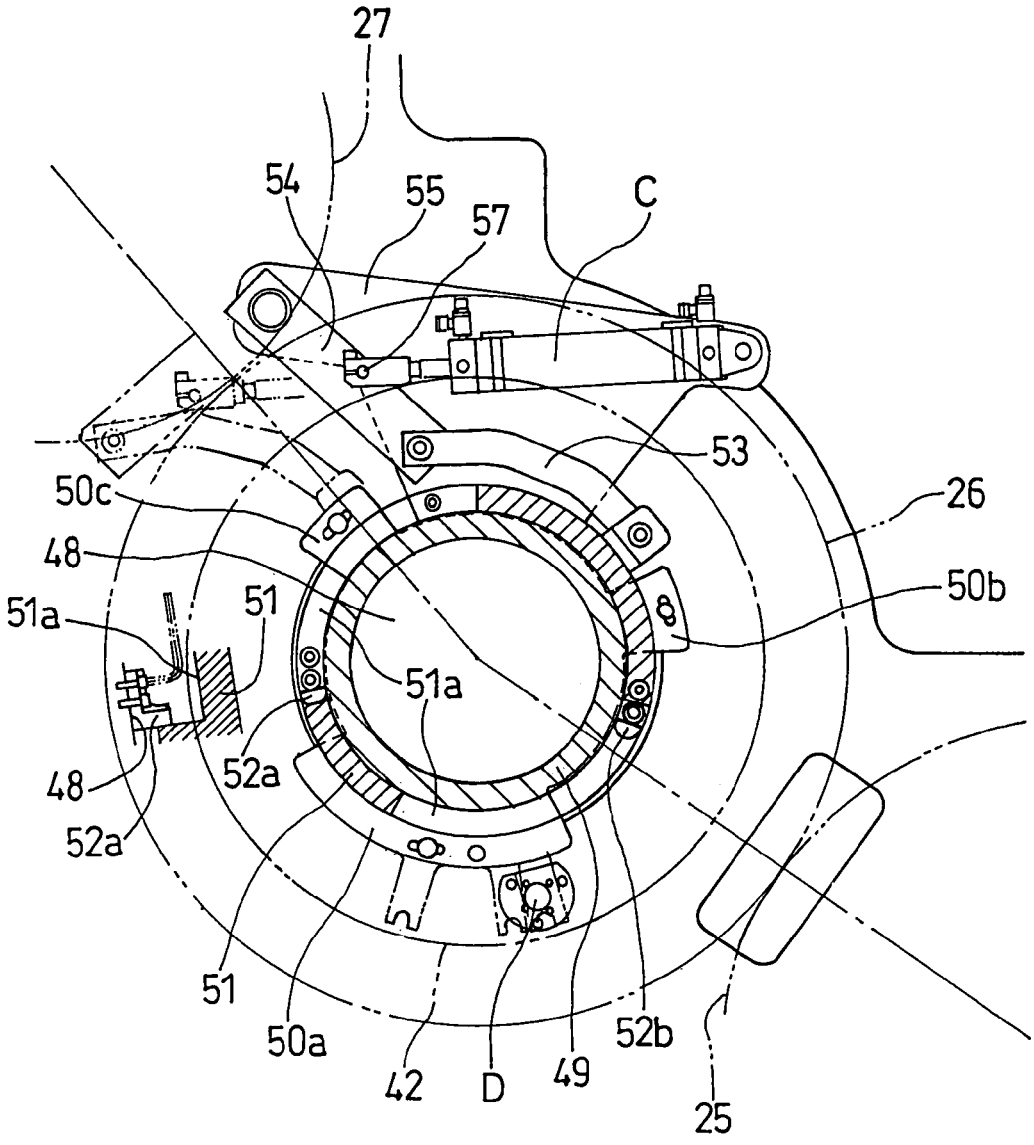
FIG. 4 is a cross-sectional view taken along the B-B line of FIG. 2 showing the embodiment of the present invention.
Figure 5:
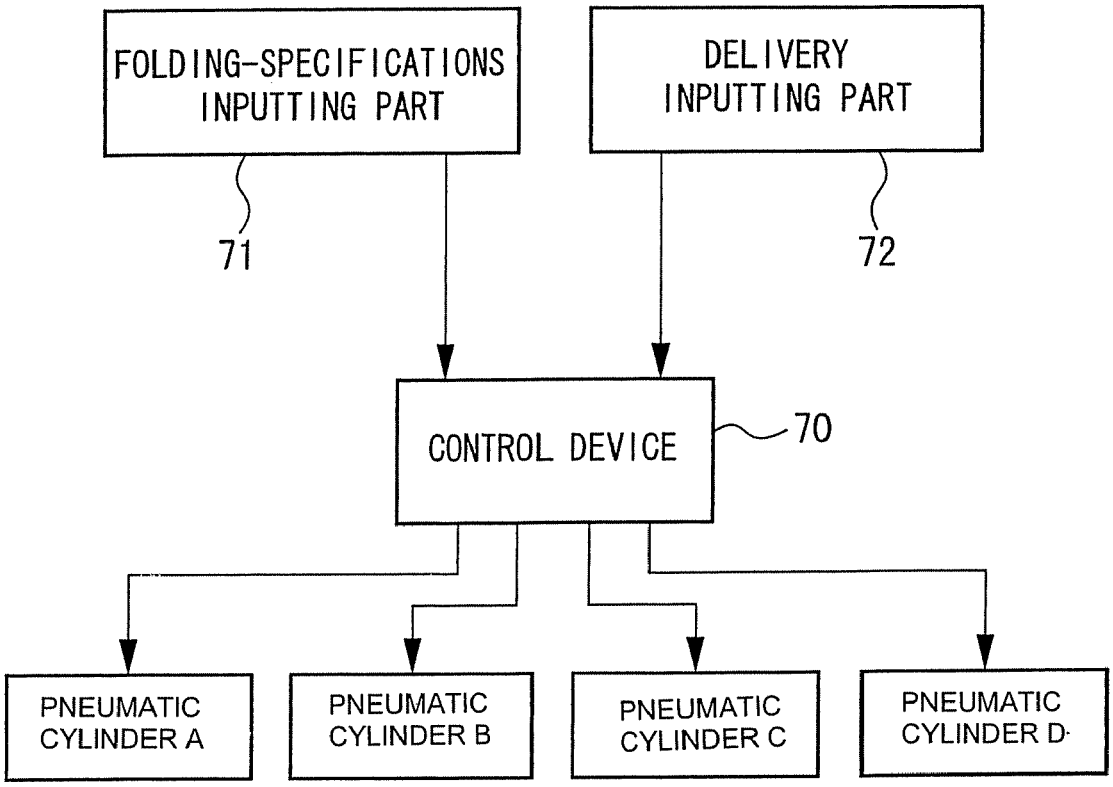
FIG. 5 is a control block diagram showing the embodiment of the present invention.

FIG. 1 is a schematic side view of a folding machine of a rotary printing press showing an embodiment of the present invention. FIG. 2 is an explanatory diagram of a structure of a cam mechanism showing the embodiment of the present invention. FIG. 3 is a view of FIG. 2 on the arrow A showing the embodiment of the present invention. FIG. 4 is a cross-sectional view taken along the B-B line of FIG. 2 showing the embodiment of the present invention. FIG. 5 is a control block diagram showing the embodiment of the present invention. FIG. 6 is a diagram explaining how pneumatic cylinders operate for each delivery mode in each folding specifications, showing the embodiment of the present invention. FIGS. 7 to 11 are respectively diagrams explaining how cams operate, showing the embodiment of the present invention.

After printed, a web W is cooled and dried, and is guided into a paper inserting part. As shown in FIG. 1, the web W is transferred to a pair of nipping rollers 20, to a pair of cross perforating cylinders 21, and to a pair of nipping rollers 22. Thereafter, the web W is transferred to a parallel folding device 23 for cutting, and folding, this web W by a predetermined dimension. This parallel folding device 23 includes a cutting cylinder 24, a folding cylinder 25, a first jaw cylinder 26, an upper second jaw cylinder 27 and a lower second jaw cylinder 28, all of which rotate respectively in directions shown by arrows in the figure.

The web W which has been transferred between the cutting cylinder 24 and the folding cylinder 25 is cut by a predetermined dimension with a cutting blade, which is not illustrated, of the cutting cylinder 24. In addition, the web W is held with a pin, which is not illustrated, of the folding cylinder 25, and thus is caused to wrap around a lower circumferential surface of the folding cylinder 25. The web thus cut (a sheet), which is held with the pin, is subsequently gripped with gripper boards 29*a* to 29*d* of the first jaw cylinder 26 in cooperation with a knife, which is not illustrated, of the folding cylinder 25 (the gripper boards are gripping-holding means, and a number of gripper boards are provided in axis directions respectively of gripper board shafts 30*a* to 30*d* arranged in positions which quarter the circumferential surface). The cut web thus gripped is turned into a signature (a sheet) while being half-folded, and is caused to wrap around, and contact, the upper circumferential surface. A number of knives 64*a* to 64*d* (gripping-holding means) are provided in axis directions respectively of knife shafts 65*a* to 65*d* arranged in positions which quarter the circumferential surface of the first jaw cylinder 26.

The upper second jaw cylinder (a former second jaw cylinder) 27 and the lower second jaw cylinder (a latter second jaw cylinder) 28 are opposed to, and in contact with, each other downstream of the first jaw cylinder 26. An upper transfer belt group 31A and an upper chopper folding device 32A are provided downstream of the upper second jaw cylinder 27. The upper transfer belt group 31A is a pair consisting of an upper transfer belt and a lower transfer belt. The upper chopper folding device 32A is positioned frontward of this upper transfer belt group 31A. A lower transfer belt group 31B and a lower chopper folding device 32B are provided downstream of the lower second jaw cylinder 28. The lower transfer belt group 31B is a pair consisting of an upper transfer belt and a lower transfer belt. The lower chopper folding device 32B is positioned backward of this lower transfer belt group 31B. A fan wheel 33 and a conveyer 34 for a delivery operation are provided downstream of the upper transfer belt group 31A. The first jaw cylinder 26, the upper second jaw cylinder 27 and the lower second jaw cylinder 28 are linked together through a gear mechanism (not illustrated) in order that the first jaw cylinder 26, the upper second jaw cylinder 27 and the lower second jaw cylinder 28 rotate respectively at revolving speeds.

A number of gripper devices (gripping-holding means, and hereinafter referred to as "grippers") 36*a* to 36*d* are provided in axis directions respectively of gripper shafts 35*a* to 35*d* arranged in positions which quarter the circumferential surface of the upper second jaw cylinder 27. Similarly, a number of gripper boards (gripping-holding means) 66*a* to 66*d* are provided in axis directions respectively of gripper board shafts 67*a* to 67*d*. In addition, a number of gripper devices (gripping-holding means, and hereinafter referred to as "grippers") 38*b* and 38*d* are provided in axis directions respectively of gripper shafts 37*b* and 37*d* arranged in positions which bisect the circumferential surface of the lower second jaw cylinder 28. Similarly, a number of gripper boards (gripping-holding means) 68*b* and 68*d* are provided in axis directions respectively of gripper board shafts 69*b* and 69*d*. The grippers 36*a* to 36*d* of the upper second jaw cylinder 27 are sequentially caused to be opposed respectively to the gripper boards 29*a* to 29*d* of the first jaw cylinder 26. The grippers 38*b* and 38*d* of the lower second jaw cylinder 28 are designed to be opposed to only the gripper boards 29*b* and 29*d* of the first jaw cylinder 26 respectively.

In addition, the first jaw cylinder 26 is provided with a cam mechanism (switching means) 41, which will be described later. The cam mechanism 41 causes the gripper boards 29*a* and 29*d* to operate in a position which makes the folding cylinder 25 and the first jaw cylinder 26 opposed to, and in contact with, each other. Thereby, the cam mechanism 41 causes the first jaw cylinder 26 to hold signatures which have been transferred one by one. Thereafter, the cam mechanism 41 is designed to perform what is called an upper combined delivery or what is called an upper-and-lower distribution delivery, and to accordingly switch transfer channels. The upper combined delivery transfers the signatures from the gripper boards 29*a* to 29*d* of the first jaw cylinder 26 to only the grippers 36*a* to 36*d* of the upper second jaw cylinder 27. The upper-and-lower distribution delivery transfers the signatures from the gripper boards 29*a* to 29*d* of the first jaw cylinder 26 alternately to the grippers 36*a* and 36*c* of the upper second jaw cylinder 27, as well as to the grippers 38*b* and 38*d* of the lower second jaw cylinder 28.

Furthermore, the cam mechanism switches up to three rotary phases (positions) of gripper opening with regard to the gripper boards 29*a* to 29*d* of the first jaw cylinder 26. This enables a parallel folding to be switched among a single fold, a double fold and a delta fold. In this case, in the folding cylinder 25, a positional relationship between the pin and the knife, both of which are not illustrated, can be adjusted by means of a double-cylinder structure in response to the folding specifications. Furthermore, in the upper second jaw cylinder 27 and the lower second jaw cylinder 28, the grippers 36*a* to 36*d* and the gripper boards 66*a* to 66*d* of the upper second jaw cylinder 27 as well as the grippers 38*b* and 38*d* and the gripper boards (gripping-holding means) 68*b* and 68*d* of the lower second jaw cylinder 28 are designed to be switched and controlled by a cam mechanism, which is not illustrated, in response to the aforementioned folding specifications. In other words, when a double fold and a delta fold are intended to be performed, a gripping change is made from the knives 64*a* to 64*d* of the first jaw cylinder 26 to the gripper boards 66*a* to 66*d* of the upper second jaw cylinder 27, or to the gripper boards 68*b* and 68*d* of the lower second jaw cylinder 28. In the course of this gripper change, the gripper boards 29*a* to 29*d* of the first jaw cylinder 26 respectively perform gripper opening operations. Incidentally, in FIG. 1, reference numerals 40A, 40B and 40C denote guide plates.

Moreover, as shown in FIGS. 2 to 4, the cam mechanism 41 includes a gripper closing cam 42, a gripper opening cam 43 for an upper use (for a first application) and a gripper opening cam 44 for a lower use (for a second application). The gripper closing cam 42 causes the gripper boards 29*a* to 29*d* of the first jaw cylinder 26 to close. The gripper opening cam 43 for the upper use (the first application) causes the gripper boards 29*a* and 29*c* (first gripping-holding means) of the first jaw cylinder 26 to open. The gripper opening cam 44 for the lower use (the second application) causes the gripper boards 29*b* and 29*d* (second gripping-holding means) of the first jaw cylinder 26 to open. In other words, a cam follower 45 which is supported by the ends respectively of the gripper shafts 30*a* and 30*c* (first gripping-holding means) of the first jaw cylinder 26 can move so as to follow both of the gripper closing cam 42 and the gripper opening cam 43 for the upper use. On the other hand, a cam follower 46 which is supported by the ends respectively of the gripper shafts 30*b* and 30*d* (second gripping-holding means) of the first jaw cylinder 26 can move so as to follow both of the gripper closing cam 42 and the gripper opening cam 44 for the lower use.

The gripper closing cam 42 is screwed so as to be connected to a sleeve 49 which is rotatably fitted into a bearing case (rotating member) 48 in a relative manner. The sleeve 49 is screwed so as to be connected to a frame 47 by means of mounting plate parts 50*a* to 50*c*. The bearing case 48 rotatably supports an end of the shaft of the first jaw cylinder 26. In addition, the bearing case 48 per se is rotatable relative to the frame 47 of the folding machine. The gripper opening cam 43 for the upper use is screwed so as to be connected to an end surface of the bearing case 48. The gripper opening cam 44 for the lower use is screwed so as to be connected to a rotating ring 51 which is rotatably fitted into the circumference of the sleeve 49.

Two gap grooves 51*a* are formed in an end surface of this rotating ring 51, the end surface being near the frame, in the circumferential direction. Two stoppers 52*a* and 52*b* are installed to the bearing case 48 in a protruding manner in a way that the stoppers 52*a* and 52*b* protrude into the gap groove 51*a*. The rotating ring 51 is designed to be positioned in two positions in the circumferential direction by making the end surface of the gap groove 51*a* abut on the two stoppers 52*a* and 52*b* selectively. In other words, a phase of the gripper opening cam 44 for the lower use, which has been screwed so as to be connected to the rotating ring 51, is switched between a position for the upper combined delivery and a position for the upper-and-lower distribution delivery.

Moreover, the rotating ring 51 is linked to an end part of a support plate (supporting member) 55, which has been screwed so as to be connected to the bearing case 48, with a link 53 and a lever 54 interposed therebetween. A base end of a head of a pneumatic cylinder C, which is the first drive means, is connected to the other end of this support plate 55 with a pin 56. An end of a piston rod of the pneumatic cylinder C is connected to an intermediate part of the lever 54 with a pin 57. Accordingly, if the pneumatic cylinder C as shown in FIG. 4 were turned from an OFF state (contracted state) to an ON state (extended state), the delivery mode is switched from the upper combined delivery to the upper-and-lower distribution delivery. In other words, the phase of the gripper opening cam 4 for the lower use is moved to a position which rotates at an angle of approximately 90 degrees to a position agreeing with the phase of the gripper opening cam 43 for the upper use. Incidentally, in a case where a contraction of the pneumatic cylinder C is going to cause the end surface of the gap groove 51*a* to abut on the stoppers 52*a* and 52*b*, the end surface of the gap groove 51*a* is designed to abut on the stoppers 52*a* and 52*b* while the pneumatic cylinder C is in a state of having a certain amount of thrust.

On the other hand, an end of a piston rod of a pneumatic cylinder B, which is the second drive means, is connected to the bearing case 48 positioned outside the frame 47 with a pin 58. A base end of a head of this pneumatic cylinder B is connected, with a pin 60, to an end of a bellcrank 59 which is swingably supported by the frame 47. A head of a piston rod of a pneumatic cylinder A, which is the second drive means, is connected to the other end of the bellcrank 59 with a pin 61. A base end of a head of this pneumatic cylinder A is connected to the frame 47 with a pin 62. Accordingly, the bearing case 48 is positioned in three positions in the circumferential direction: a first position is determined when the pneumatic cylinder A as shown in FIG. 3 is in an ON state (extended state) and the pneumatic cylinder B as shown in FIG. 3 is in an OFF state (contracted state); a second position is determined when the pneumatic cylinder A remains in the ON state and the pneumatic cylinder B is turned to an ON state (extended state); and a third position is determined when the pneumatic cylinder A is turned to an OFF state (contracted state) and the pneumatic cylinder B remains in the OFF state (contracted state).

In other words, the phase of the gripper opening cam 43 for the upper use and the phase of the gripper opening cam 44 for the lower use are switched among three positions corresponding to a single fold mode, a double fold mode and a delta fold mode in the folding specifications. The gripper opening cam 43 for the upper use is screwed so as to be connected to the bearing case 48. The gripper opening cam 44 for the lower use is screwed so as to be connected to the rotating ring 51 which can rotate integrally with the bearing case 48 with the support plate 55 and the like interposed therebetween. In FIG. 3, a position where an engagement piece 48*a* illustrated by a solid line is located shows a position corresponding to the double fold mode. A rightward position where an engagement piece 48*a* illustrated by a long dashed short dashed line is located shows a position corresponding to the single fold mode. A leftward position where an engagement piece 48*a* illustrated by the other long dashed short dashed line is located shows a position corresponding to the delta fold mode.

A position of the engagement piece 48*a* is checked by stoppers 63*a* and 63*b*, which are annexed to the frame 47, in each of the positions corresponding respectively to the single fold mode and the double fold mode, when the pneumatic cylinder B comes to abut thereon while the pneumatic cylinder B is in a state of having a certain amount of thrust. In addition, the position of the engagement piece 48*a* is checked by a stopper 63*c*, which is caused to protrude by a pneumatic cylinder D, as third drive means, mounted on the frame 47, in the position corresponding to the double fold mode, when the pneumatic cylinder B comes to abut thereon while the pneumatic cylinder B is in a state of having a certain amount of thrust. Similarly, the position of the bellcrank 59 is checked by stoppers 63*d* and 63*e*, which are annexed to the frame 47, when the pneumatic cylinder A comes to abut thereon while the pneumatic cylinder A is in a state of having a certain amount of thrust.

Additionally, drives respectively of the pneumatic cylinders A to D are controlled by a control device 70, as shown in FIG. 5. Signals respectively from a folding-specifications inputting part 71 and a delivery inputting part 72 are inputted into the control device 70. As shown in FIG. 6, the control device 70 controls extension and contraction of each of the pneumatic cylinder A to D in response to the folding specifications and the delivery modes.

The cam mechanism 41 is configured in the aforementioned manner. Then, descriptions will be provided for operations of the cam mechanism 41 with reference to a diagram explaining how pneumatic cylinders operate for each delivery mode in each folding specifications as shown in FIG. 6.

First of all, in the case of the single fold in the upper-and-lower distribution delivery, if the pneumatic cylinder C is turned on (extended), this causes the rotating ring 51 to rotate counterclockwise to the maximum limit in FIG. 4. Accordingly, the gripper opening cam 44 for the lower use is positioned in a position which is away from the gripper opening cam 43 for the upper use at an angle of approximately 90 degrees.

Figure 7:
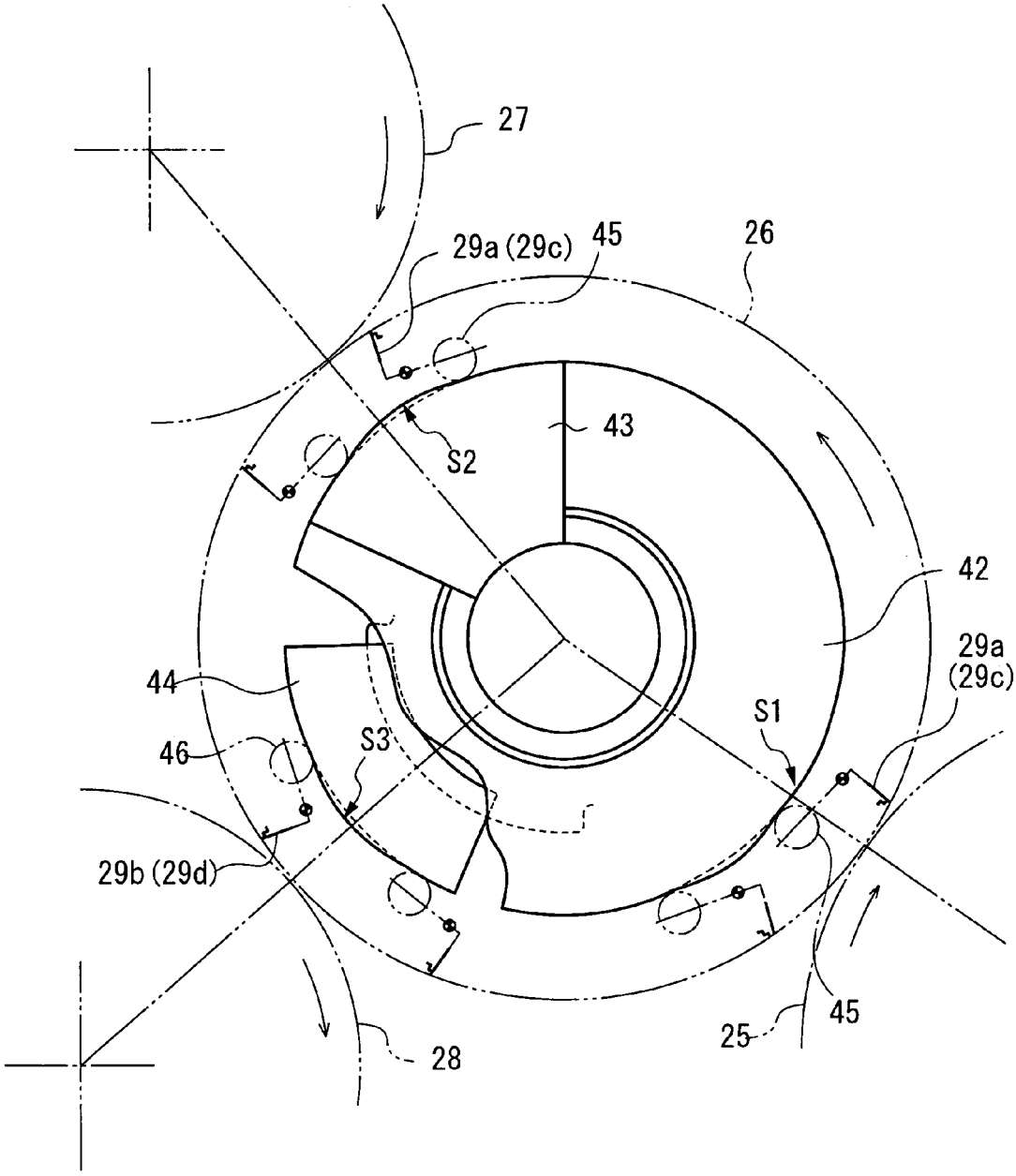
FIG. 7 is a diagram explaining how cams operate, showing the embodiment of the present invention.

On the other hand, if both the pneumatic cylinders A and B are turned off (contracted) and concurrently the pneumatic cylinder D is also turned off, this causes the bearing case 48 to rotate counterclockwise to the maximum limit in FIG. 3 while the bearing case 48 is not checked by the stopper 63*c*. Accordingly, the gripper opening cam 43 for the upper use is positioned in a position closest to a point which makes the first jaw cylinder 26 and the upper second jaw cylinder 27 opposed to, and in contact with, each other, as shown in FIG. 7. The gripper opening cam 44 for the lower use is positioned in a position closest to a point which makes the first jaw cylinder 26 and the lower second jaw cylinder 28 opposed to, and in contact with, each other, as shown in FIG. 7.

As a result of these, with regard to a single-folded signature which is gripped and closed by the gripper boards 29*a* and 29*c* of the first jaw cylinder 26 in the vicinity of a point which makes the folding cylinder 25 and the first jaw cylinder 26 opposed to, and in contact with, each other, as shown in FIG. 7 (see a lift curve S1 of a gripper closing of the gripper closing cam 42 in FIG. 7), the gripper opening cam 43 for the upper use causes the single-folded signature to be released from being gripped by the gripper boards 29*a* and 29*c* (see a lift curve S2 of a gripper opening of the gripper opening cam 43 for the upper use in FIG. 7). Thereby, the single-folded signature is transferred to the upper second jaw cylinder 27, and thus is gripped by the grippers 36*a* and 36*c* of the upper second jaw cylinder 27. Thereafter, the single-folded signature is delivered towards the upper chopper folding device 32A (see FIG. 1).

On the other hand, in the case where the single-folded signature is gripped and closed by the gripper boards 29*b* and 29*d* of the first jaw cylinder 26 (see the lift curve S1 of the gripper closing of the gripper closing cam 42 in FIG. 7), when the gripper opening cam 44 for the lower use causes the single-folded signature to be released from being gripped by the gripper boards 29*b* and 29*d* (see the lift curve S3 of the gripper opening of the gripper opening cam 44 for the lower use in FIG. 7) after the single-folded signature passes a point which makes the first jaw cylinder 26 and the upper second jaw cylinder 27 opposed to, and in contact with, each other, the single-folded signature is transferred to the lower second jaw cylinder 28, and thus is gripped by the grippers 38*b* and 38*d* of the lower second jaw cylinder 28. Thereafter, the single-folded signature is delivered towards the lower chopper folding device 32B (see FIG. 1).

Figure 8:
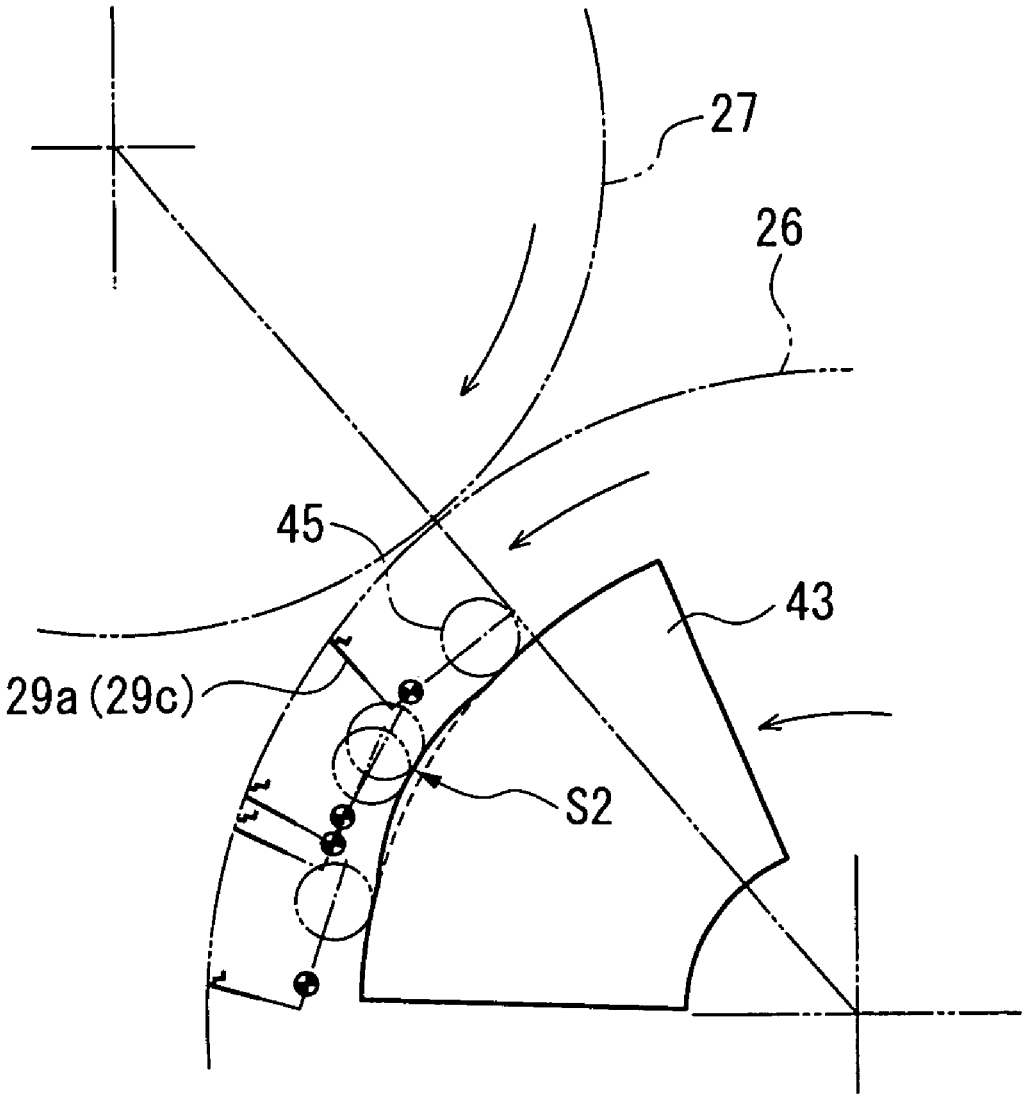
FIG. 8 is a diagram explaining how the cams operate, showing the embodiment of the present invention.
Figure 9:
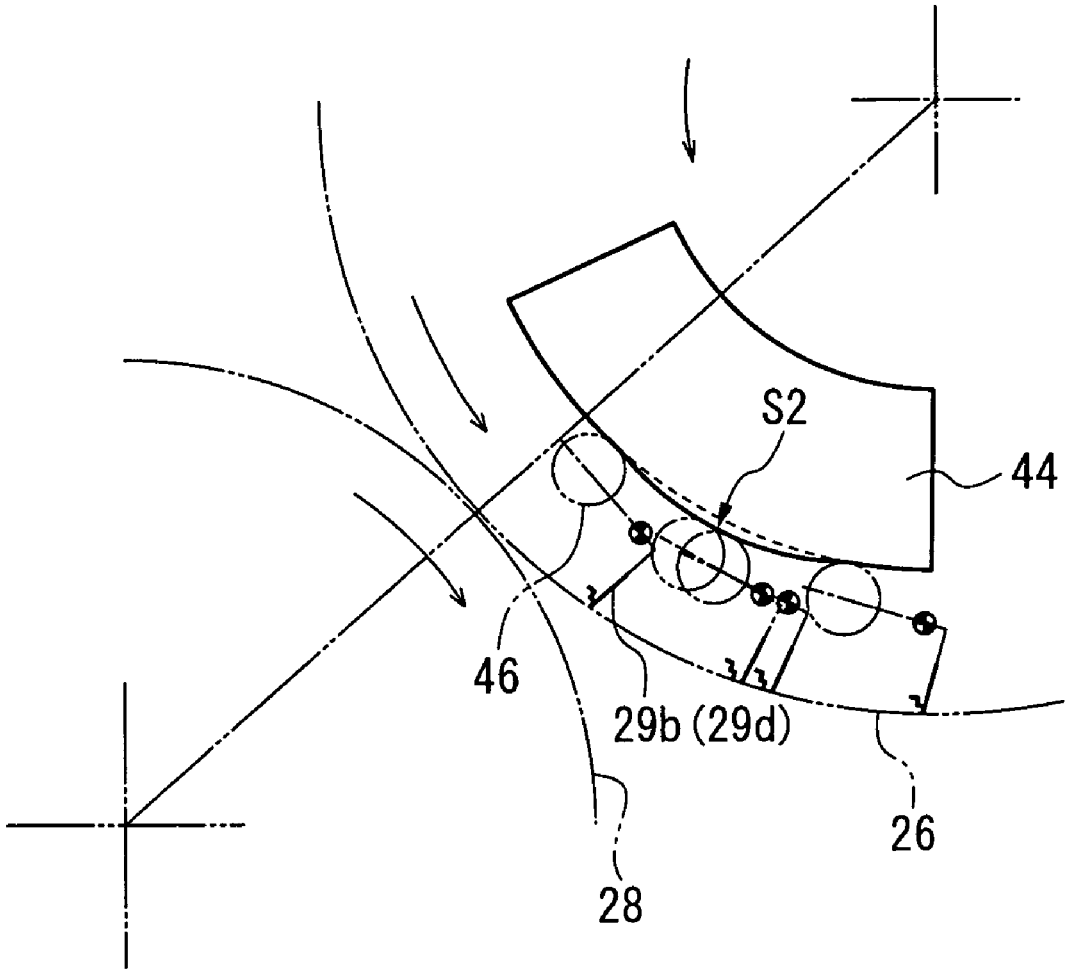
FIG. 9 is a diagram explaining how the cams operate, showing the embodiment of the present invention.

Next, in the case of the double fold in the upper-and-lower distribution delivery, if the pneumatic cylinder C is turned on and the pneumatic cylinder B is turned off as in the case of the single fold, and if concurrently both the pneumatic cylinders A and D are controlled so as to be turned from off to on, this causes the bearing case 48 to rotate clockwise in FIG. 3, and finally the bearing case 48 is checked by the stopper 63*c*. Accordingly, as shown in FIGS. 8 and 9, both the gripper opening cam 43 for the upper use and the gripper opening cam 44 for the lower use are caused to rotate counterclockwise, for example, at an angle of 23.5 degrees from the position corresponding to the single fold. Thus, the positions respectively of the gripper opening cam 43 for the upper use and the gripper opening cam 44 for the lower are determined.

As a result of this, with regard to the single-folded signature which is gripped and closed by the gripper boards 29*a* and 29*c* of the first jaw cylinder 26 in the vicinity of a point which makes the folding cylinder 25 and the first jaw cylinder 26 opposed to, and in contact with, each other (see the lift curve S1 of the gripper closing of the gripper closing cam 42 in FIG. 7), the gripper opening cam 43 for the upper use causes the single-folded signature (approximately a half of the signature in terms of its length) to be released from being gripped (see the lift curve S2 of the gripper opening of the gripper opening cam 43 for the upper use in FIG. 7), after the gripper boards 29*a* and 29*c* pass the point which makes the first jaw cylinder 26 and the upper second jaw cylinder 27 opposed to, and in contact with, each other. In addition, the gripper boards 66*a* and 66*c* of the upper second jaw cylinder 27 double-fold the single-folded signature in cooperation with the knives 64*a* and 64*c* of the first jaw cylinder 26 in the vicinity of the point which makes the first jaw cylinder 26 and the upper second jaw cylinder 27 opposed to, and in contact with, each other. The signature thus double-folded is delivered towards the upper chopper folding device 32A (see FIG. 1).

On the other hand, with regard to the single-folded signature which is gripped and closed by the gripper boards 29*b* and 29*d* of the first jaw cylinder 26 (see the lift curve S1 of the gripper closing of the gripper closing cam 42 in FIG. 7), the gripper opening cam 44 for the lower use causes the single-folded signature (approximately a half of the signature in terms of its length) to be released from being gripped (see a lift curve S3 of a gripper opening of the gripper opening cam 44 for the lower use in FIG. 7), after the single-folded signature passes the point which makes the first jaw cylinder 26 and the upper second jaw cylinder 27 opposed to, and in contact with, each other, and further after the gripper boards 29*b* and 29*d* pass a point which makes the first jaw cylinder 26 and the lower second jaw cylinder 28 opposed to, and in contact with, each other. In addition, the gripper boards 68*a* and 68*c* of the lower second jaw cylinder 28 double-fold the single-folded signature in cooperation with the knives 64*b* and 64*d* of the first jaw cylinder 26 in the vicinity of the point which makes the first jaw cylinder 26 and the lower second jaw cylinder 28 opposed to, and in contact with, each other. The signature thus double-folded is delivered towards the lower chopper folding device 32B (see FIG. 1).

Figure 10:
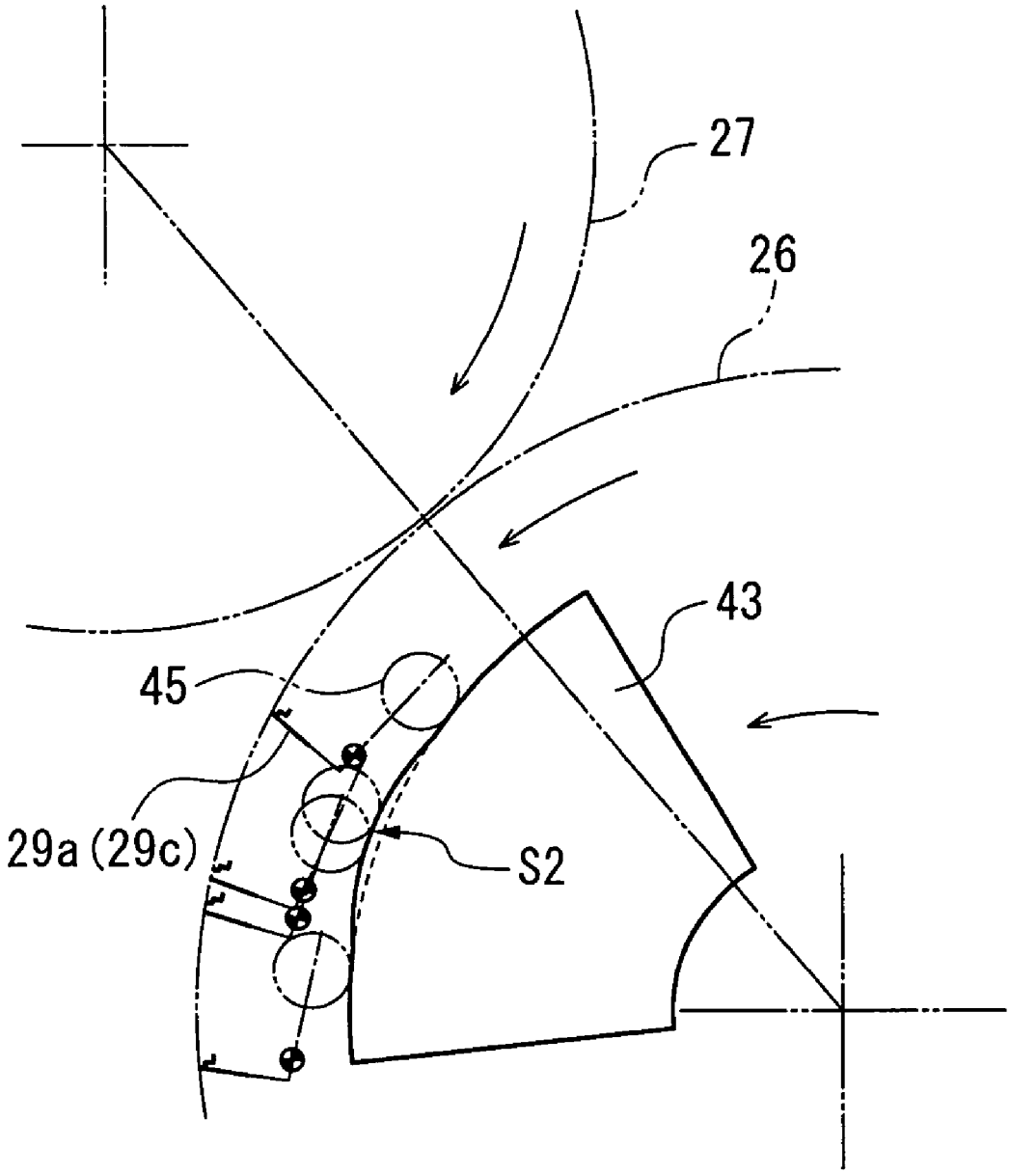
FIG. 10 is a diagram explaining how the cams operate, showing the embodiment of the present invention.
Figure 11:
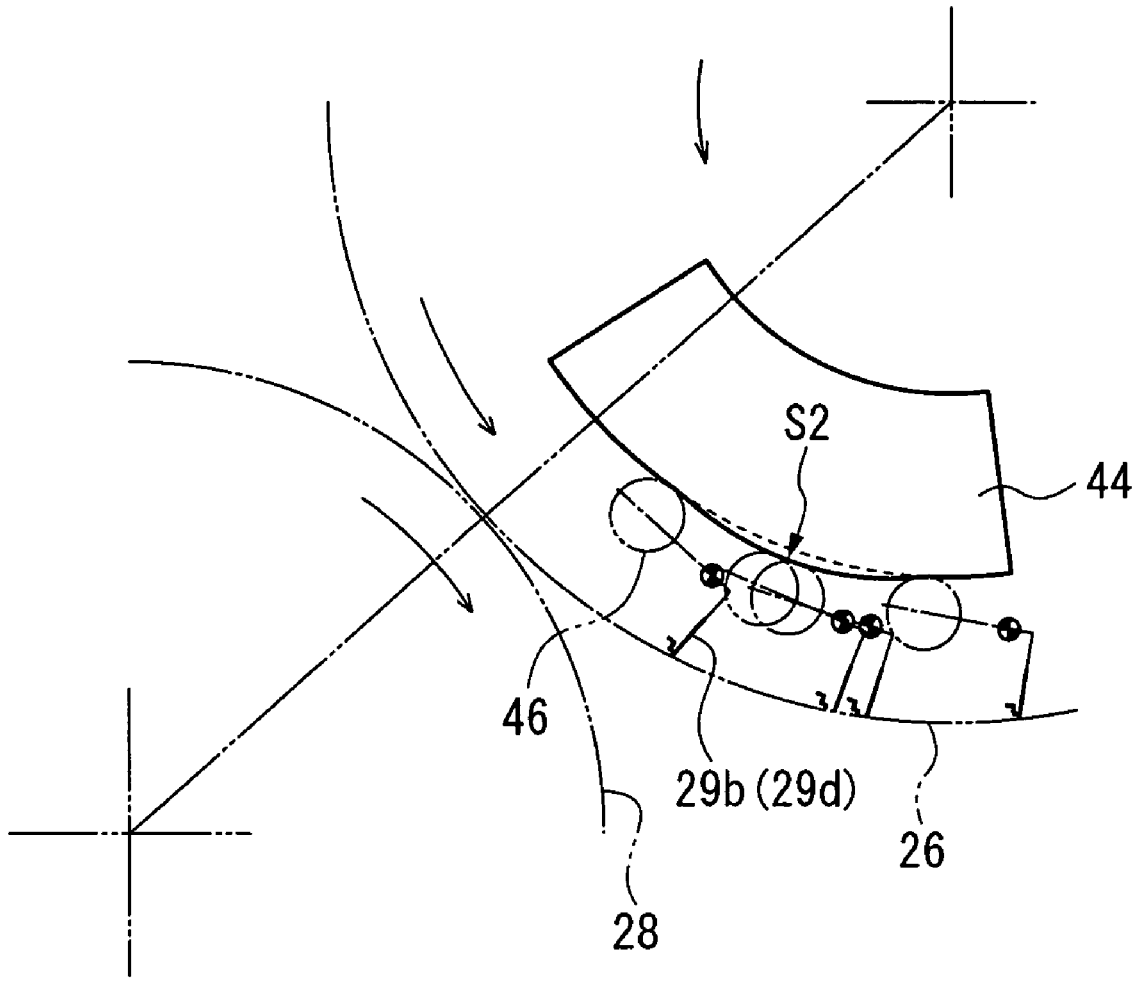
FIG. 11 is a diagram explaining how the cams operate, showing the embodiment of the present invention.
Figure 12:
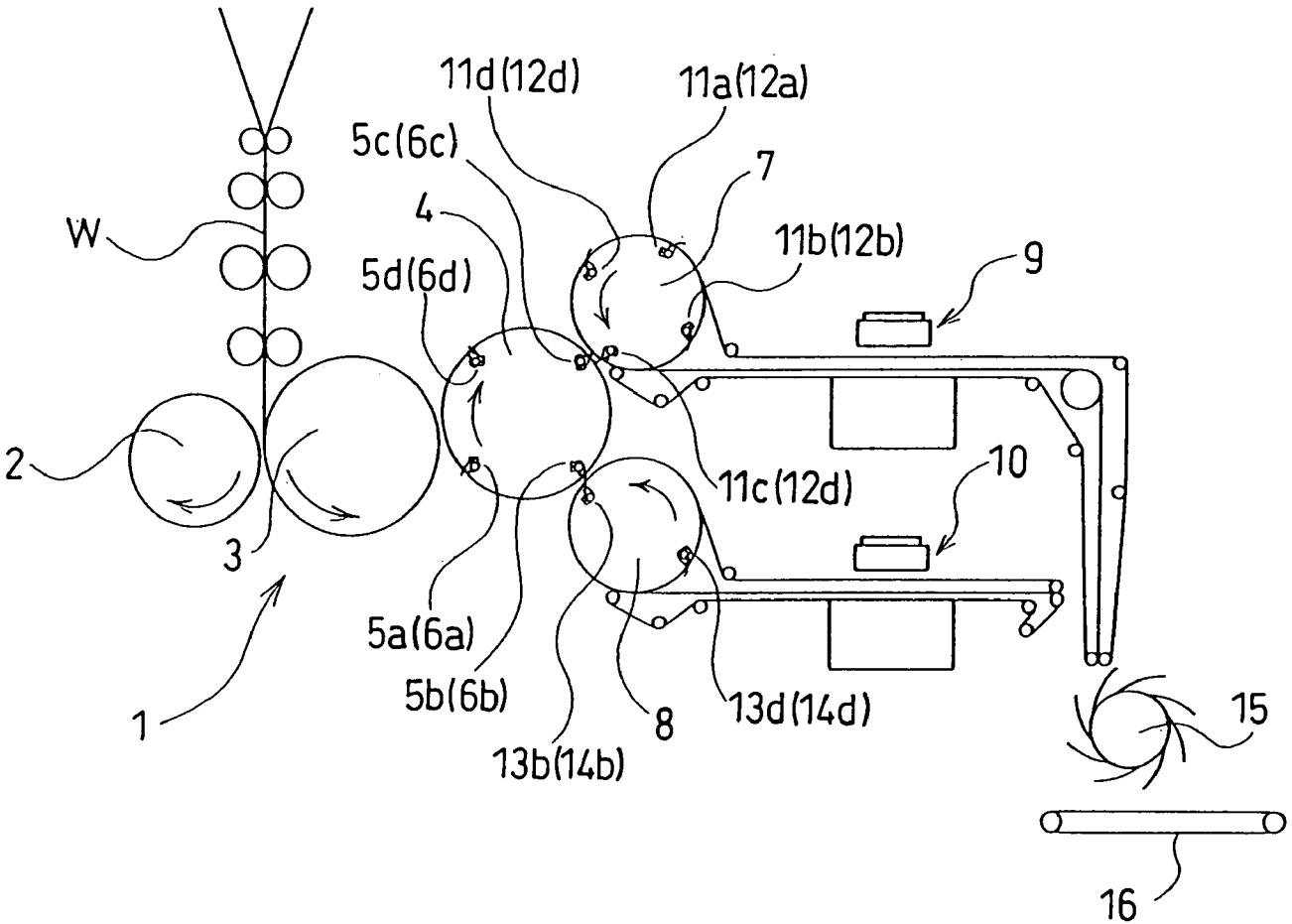
FIG. 12 is a schematic side view of a parallel folding device of a conventional folding machine.

Next, in the case of the delta fold in the upper-and-lower distribution delivery, if the pneumatic cylinder A is turned on and the pneumatic cylinder C is turned on as in the case of the double fold, and if concurrently the pneumatic cylinder B is controlled so as to be turned from off to on and the pneumatic cylinder D is controlled so as to be turned from on to off, this causes the bearing case 48 to rotate clockwise to the maximum limit in FIG. 3 while the bearing case 48 is not checked by the stopper 63*c*. Accordingly, as shown in FIGS. 10 and 11, both the gripper opening cam 43 for the upper use and the gripper opening cam 44 for the lower use are caused to rotate counterclockwise, for example, at an angle of 31 degrees from the position corresponding to the single fold. Thus, the positions respectively of the gripper opening cam 43 for the upper use and the gripper opening cam 44 for the lower are determined.

As a result of this, with regard to the single-folded signature which is gripped and closed by the gripper boards 29*a* and 29*c* of the first jaw cylinder 26 in the vicinity of a point which makes the folding cylinder 25 and the first jaw cylinder 26 opposed to, and in contact with, each other (see the lift curve S1 of the gripper closing of the gripper closing cam 42 in FIG. 7), the gripper opening cam 43 for the upper use causes the single-folded signature (approximately two-thirds of the signature in terms of its length) to be released from being gripped (see the lift curve S2 of the gripper opening of the gripper opening cam 43 for the upper use in FIG. 7), after the gripper boards 29*a* and 29*c* pass the point which makes the first jaw cylinder 26 and the upper second jaw cylinder 27 opposed to, and in contact with, each other. In addition, the gripper boards 66*a* and 66*c* of the upper second jaw cylinder 27 delta-fold the single-folded signature in cooperation with the knives 64*a* and 64*c* of the first jaw cylinder 26 in the vicinity of the point which makes the first jaw cylinder 26 and the upper second jaw cylinder 27 opposed to, and in contact with, each other. The signature thus delta-folded is delivered towards the upper chopper folding device 32A (see FIG. 1).

On the other hand, with regard to the single-folded signature which is gripped and closed by the gripper boards 29*b* and 29*d* of the first jaw cylinder 26 (see the lift curve S1 of the gripper closing of the gripper closing cam 42 in FIG.

7), the gripper opening cam 44 for the lower use causes the single-folded signature (approximately two-thirds of the signature in terms of its length) to be released from being gripped (see the lift curve S3 of the gripper opening of the gripper opening cam 44 for the lower use in FIG. 7), after the single-folded signature passes the point which makes the first jaw cylinder 26 and the upper second jaw cylinder 27 opposed to, and in contact with, each other, and further after the gripper boards 29*b* and 29*d* pass the point which makes the first jaw cylinder 26 and the lower second jaw cylinder 28 opposed to, and in contact with, each other. In addition, the gripper boards 68*b* and 68*d* of the lower second jaw cylinder 28 delta-fold the single-folded signature in cooperation with the knives 64*b* and 64*d* of the first jaw cylinder 26 in the vicinity of the point which makes the first jaw cylinder 26 and the lower second jaw cylinder 28 opposed to, and in contact with, each other. The signature thus delta-folded is delivered towards the lower chopper folding device 32B (see FIG. 1).

Finally, in the case of the upper combined delivery, except that the pneumatic cylinder C is controlled to be turned from on, which is selected for the upper-and-lower distribution delivery, to off regardless of folding specifications, the other pneumatic cylinders A, B and D are controlled as in the case of the upper-and-lower distribution delivery.

Accordingly, the rotating ring 51 is caused to rotate clockwise to the maximum limit in FIG. 4. Thus, the phase of the gripper opening cam 44 for the lower use is moved from a position, which has made the phase of the gripper opening cam 44 for the lower use away from the phase of the gripper opening cam 43 for the upper use at an angle of approximately 90 degrees, to a position, which makes the phase of the gripper opening cam 44 for the lower use agree with the phase of the gripper opening cam 43 for the upper use.

As a result of this, in the case of the single fold, with regard to a single-folded signature which is gripped and closed by the gripper boards 29*a* and 29*c* of the first jaw cylinder 26 in the vicinity of a point which makes the folding cylinder 25 and the first jaw cylinder 26 opposed to, and in contact with, each other (see the lift curve S1 of the gripper closing of the gripper closing cam 42 in FIG. 7), the gripper opening cam 43 for the upper use causes the single-folded signature to be released from being gripped by the gripper boards 29*a* and 29*c* (see the lift curve S2 of the gripper opening of the gripper opening cam 43 for the upper use in FIG. 7). Thereby, the single-folded signature is transferred to the upper second jaw cylinder 27, and thus is gripped by the grippers 36*a* and 36*c* of the upper second jaw cylinder 27. Thereafter, the single-folded signature is delivered towards the upper chopper folding device 32A (see FIG. 1).

On the other hand, in the case where the single-folded signature is gripped and closed by the gripper boards 29*b* and 29*d* of the first jaw cylinder 26 (see the lift curve S1 of the gripper closing of the gripper closing cam 42 in FIG. 7), the gripper opening cam 44 for the lower use, whose phase is in the same position as the phase of the gripper opening cam 43 for the upper use is, causes the single-folded signature to be released from being gripped by the gripper boards 29*b* and 29*d* (see the lift curve S3 of the gripper opening of the gripper opening cam 44 for the lower use in FIG. 7). Thereby, the single-folded signature is transferred to the upper second jaw cylinder 27, and thus is gripped by the grippers 36*b* and 36*d* of the upper second jaw cylinder 27. Thereafter, the single-folded signature is delivered towards the upper chopper folding device 32A (see FIG. 1).

In the case of the double fold, with regard to the single-folded signature which is gripped and closed by the gripper boards 29*a* and 29*c* of the first jaw cylinder 26 in the vicinity of the point which makes the folding cylinder 25 and the first jaw cylinder 26 opposed to, and in contact with, each other (see the lift curve S1 of the gripper closing of the gripper closing cam 42 in FIG. 7), the gripper opening cam 43 for the upper use causes the single-folded signature (approximately a half of the signature in terms of its length) to be released from being gripped (see the lift curve S2 of the gripper opening of the gripper opening cam 43 for the upper use in FIG. 7), after the gripper boards 29*a* and 29*c* pass the point which makes the first jaw cylinder 26 and the upper second jaw cylinder 27 opposed to, and in contact with, each other. In addition, the gripper boards 66*a* and 66*c* of the upper second jaw cylinder 27 double-fold the single-folded signature in cooperation with the knives 64*a* and 64*c* of the first jaw cylinder 26 in the vicinity of the point which makes the first jaw cylinder 26 and the upper second jaw cylinder 27 opposed to, and in contact with, each other. The signature thus double-folded is delivered towards the upper chopper folding device 32A (see FIG. 1).

On the other hand, with regard to the single-folded signature which is gripped and closed by the gripper boards 29*b* and 29*d* of the first jaw cylinder 26 (see the lift curve S1 of the gripper closing of the gripper closing cam 42 in FIG. 7), the gripper opening cam 44 for the lower use, whose phase is in the same position as the phase of the gripper opening cam 43 for the upper use is, causes the single-folded signature (approximately a half of the signature in terms of its length) to be released from being gripped (see a lift curve S3 of a gripper opening of the gripper opening cam 44 for the lower use in FIG. 7), after the gripper boards 29*b* and 29*d* pass the point which makes the first jaw cylinder 26 and the lower second jaw cylinder 28 opposed to, and in contact with, each other. In addition, the gripper boards 66*b* and 66*d* of the upper second jaw cylinder 27 double-fold the single-folded signature in cooperation with the knives 64*b* and 64*d* of the first jaw cylinder 26 in the vicinity of the point which makes the first jaw cylinder 26 and the upper second jaw cylinder 27 opposed to, and in contact with, each other. The signature thus double-folded is delivered towards the upper chopper folding device 32A (see FIG. 1).

Next, in the case of the delta fold, with regard to the single-folded signature which is gripped and closed by the gripper boards 29*a* and 29*c* of the first jaw cylinder 26 in the vicinity of the point which makes the folding cylinder 25 and the first jaw cylinder 26 opposed to, and in contact with, each other (see the lift curve S1 of the gripper closing of the gripper closing cam 42 in FIG. 7), the gripper opening cam 43 for the upper use causes the single-folded signature (approximately two-thirds of the signature in terms of its length) to be released from being gripped (see the lift curve S2 of the gripper opening of the gripper opening cam 43 for the upper use in FIG. 7), after the gripper boards 29*a* and 29*c* pass the point which makes the first jaw cylinder 26 and the upper second jaw cylinder 27 opposed to, and in contact with, each other. In addition, the gripper boards 66*a* and 66*c* of the upper second jaw cylinder 27 delta-fold the single-folded signature in cooperation with the knives 64*a* and 64*c* of the first jaw cylinder 26 in the vicinity of the point which makes the first jaw cylinder 26 and the upper second jaw cylinder 27 opposed to, and in contact with, each other. The signature thus delta-folded is delivered towards the upper chopper folding device 32A (see FIG. 1).

On the other hand, with regard to the single-folded signature which is gripped and closed by the gripper boards

29*b* and 29*d* of the first jaw cylinder 26 (see the lift curve S1 of the gripper closing of the gripper closing cam 42 in FIG. 7), the gripper opening cam 44 for the lower use, whose phase is in the same position as the phase of the gripper opening cam 43 for the upper use is, causes the single-folded signature (approximately two-thirds of the signature in terms of its length) to be released from being gripped (see the curve S3 of a gripper opening of the gripper opening cam 44 for the lower use in FIG. 7), after the gripper boards 29*b* and 29*d* pass the point which makes the first jaw cylinder 26 and the lower second jaw cylinder 28 opposed to, and in contact with, each other. In addition, the gripper boards 66*b* and 66*d* of the upper second jaw cylinder 27 delta-fold the single-folded signature in cooperation with the knives 64*b* and 64*d* of the first jaw cylinder 26 in the vicinity of the point which makes the first jaw cylinder 26 and the upper second jaw cylinder 27 opposed to, and in contact with, each other. The signature thus delta-folded is delivered towards the lower chopper folding device 32B (see FIG. 1).

According to the present invention, the gripper closing cam 42, the gripper opening cam 43 for the upper use and the gripper opening cam 44 for the lower use in the first jaw cylinder 26 are formed separately from one another in the aforementioned manner. In addition, the gripper opening cam 43 for the upper use and the gripper opening cam 44 for the lower use are provided so as to be rotatable relative to the gripper closing cam 42. Furthermore, the gripper opening cam 44 for the lower use is provided so as to be rotatable relative to the gripper opening cam 43 for the upper use. Accordingly, if the rotary phases respectively of the gripper opening cam 44 for the lower use and the gripper opening cam 43 for the upper use are made different from each other, this enables the upper-and-lower delivery. If the rotary phases respectively of the gripper opening cam 44 for the lower use and the gripper opening cam 43 for the upper use are caused to agree with each other, this enables the upper combined delivery. Moreover, if the rotary phases respectively of the gripper opening cam 44 for the lower use and the gripper opening cam 43 for the upper use are changed to the three positions relative to the gripper closing cam 42, the folding specifications can be switched among the single fold mode, the double fold mode and the delta fold mode.

In addition, the control device 70 controls the drives respectively of the pneumatic cylinders A, B and C. The pneumatic cylinders A and B cause the gripper opening cam 43 for the upper use and the gripper opening cam 44 for the lower use respectively to rotate by means of the bearing case 48. The pneumatic cylinder C causes the gripper opening cam 44 for the lower use to rotate by means of the rotating ring 51. The drive control automates the switching of the delivery modes and the folding operations. This enables load on an operator to be reduced, and enables the switching work to be performed swiftly.

Furthermore, with regard to the positions of the bearing case 48 corresponding respectively to the folding specifications, the pneumatic cylinders A and B bring the bearing case 48 into contact with the stoppers 63*a* to 63*e* while each of the pneumatic cylinders A and B has a certain amount of thrust, thus positioning the bearing case 48. With regard to the positions of the rotating ring 51 corresponding respectively to the delivery operations, the pneumatic cylinder C brings the rotating ring 51 into contact with the stoppers 52*a* and 52*b* while the pneumatic cylinder C has a certain amount of thrust, thus positioning the rotating ring 51. Accordingly, even if a reaction force is exerted by disturbance or the like, the reaction force can be overcome. This enables the positioning to be performed reliably.

Additionally, the cam mechanism 41 includes the gripper closing cam 42 fixed to the frame 47 as well as the gripper opening cam 43 for the upper use and the gripper opening cam 44 for the lower use, both of which are movably supported relative to the frame 47. In addition, the cooperation of the gripper closing cam 42, the gripper opening cam 43 for the upper use and the cam follower 45 causes the gripper boards 29*a* and 29*c* to operate. Furthermore, the cooperation of the gripper closing cam 42, the gripper opening cam 44 for the lower use and the cam follower 46 causes the gripper boards 29*b* and 29*d* to operate. The cam mechanism 41, which has both the function of switching the delivery modes and the function of switching the folding specifications, can be realized with as small a number of cams as possible. Accordingly, decrease of parts in number enables the structure to be simplified, and the costs can be reduced. In addition, the rotating ring 51 along with the pneumatic cylinder C which is the means for driving the rotating ring 51 are supported on the bearing case 48 which the pneumatic cylinders A and B cause to rotate. For this reason, the number of parts can be reduced further.

It should be noted that the present invention is not limited to the aforementioned embodiment, and that the present invention can be modified variously within the scope which does not depart from the spirit of the present invention. For example, motors or the like may be used instead of the pneumatic cylinders which are the drive means. In addition, the transferring of the signature from the gripper boards to the grippers may be replaced with the transferring of the signature from the grippers to grippers. Furthermore, a lower second jaw cylinder (with four grippers) may be used as the former second jaw cylinder, and an upper second jaw cylinder (with two grippers) may be used as the latter second jaw cylinder (in this case, a combined delivery is performed therebelow), although the upper second jaw cylinder (with the four grippers) is used as the former second jaw cylinder, and the lower second jaw cylinder (with the two grippers) is used as the latter second jaw cylinder, in the case of the aforementioned embodiment. Moreover, with regard to the number of means for holding the sheet, two (two grippers) may be for the upper second jaw cylinder, and one (one gripper) may be for the lower second jaw cylinder.

According to the present invention to be carried out by the aforementioned configuration, delivery modes can be switched by the switching means among the upper combined delivery, the lower combined delivery and the upper-and-lower distribution deliver, as well as the folding specifications for parallel folding operations can be switched by the switching means. Thus, the present invention can realize a highly versatile folding machine.

What is claimed is:

1. A parallel folding device of a folding machine, comprising:

a folding-specifications inputting part through which folding specifications are inputted;

a delivery inputting part through which delivery channels are inputted;

a folding cylinder for transferring a sheet;

a first jaw cylinder including gripping-holding means for gripping the sheet, which has been held by the folding cylinder, in a plurality of positions in the circumferential direction, the gripping-holding means of the first jaw cylinder including first gripping-holding means and second gripping-holding means;

one second jaw cylinder, which is opposed to, and in contact with, the first jaw cylinder, which includes third gripping-holding means for holding the sheet in a plurality of positions in the circumferential direction, and which is rotatably supported;

the other second jaw cylinder, which is opposed to, and in contact with, the first jaw cylinder, which includes fourth gripping-holding means for holding the sheet, and which is rotatably supported; and switching means, which switches the delivery channels in a way that, after the gripping-holding means of the first jaw cylinder are caused to operate in a position making the folding cylinder and the first jaw cylinder opposed to, and in contact with, each other, as well as after accordingly the first jaw cylinder is caused to hold the sheet thus transferred, the sheet is transferred from the gripping-holding means of the first jaw cylinder to any one of only the third gripping-holding means of the one second jaw cylinder as well as the third gripping-holding means of the one second jaw cylinder and the fourth gripping-holding means of the other second jaw cylinder, and which concurrently performs the switching of the folding specifications from the first jaw cylinder to at least any one of the one second jaw cylinder and the other second jaw cylinder in each of the delivery channels, wherein, the first gripping-holding means is operated in order that a sheet can be transferred to the third gripping-holding means, the second gripping-holding means is operated in order that a sheet can be transferred from the first gripping-holding means and the second gripping-holding means to the third gripping-holding means, and thereby the sheet is transferred from the gripping-holding means of the first jaw cylinder to only the third gripping-holding means, and the second gripping-holding means is operated in order that the sheet is transferred from the first gripping-holding means to the third gripping-holding means of the one second jaw cylinder, and in order that the sheet is transferred from the second gripping-holding means to the fourth gripping-holding means, and thereby the sheet is transferred from the gripping-holding means to the third gripping-holding means and the fourth gripping-holding means.

2. The parallel folding device of a folding machine according to claim 1, wherein the switching means switches the folding specifications among a single fold, a double fold and a delta fold.

3. The parallel folding device of a folding machine according to claim 1, wherein:

the first jaw cylinder includes the gripping-holding means respectively in four positions in the circumferential direction;

the former second jaw cylinder includes the gripping-holding means respectively in four positions in the circumferential direction, and the gripping-holding means respectively in the other four positions in the circumferential direction; and the latter second jaw cylinder includes the gripping-holding means respectively in two positions in the circumferential direction, and the gripping-holding means respectively in the other two positions in the circumferential direction.

4. The parallel folding device of a folding machine according to claim 1, wherein:

the switching means includes a first cam for switching delivery channels from a first delivery channel to a second delivery channel, which is supported to be movable relative to a frame, and which operates the second gripping-holding means, and the switching means switches the delivery channels by moving the first cam for switching delivery channels from the first delivery channel to the second delivery channel.

5. The parallel folding device of a folding machine according to claim 4, wherein:

the switching means further includes a second cam for switching delivery channels from the second delivery channel to the first delivery channel, which is supported to be movable relative to the frame, and which operated the first gripping-holding means, and the switching means switches the folding specifications by moving the first cam for switching delivery channels from the first delivery channel to the second delivery channel and the second cam for switching delivery channels from the second delivery channel to the first delivery channel.

6. A parallel folding device of a folding machine, comprising:

a folding-specifications inputting part through which folding specifications are inputted;

a delivery inputting part through which the delivery channels are inputted;

a folding cylinder for transferring a sheet;

a first jaw cylinder including gripping-holding means for gripping the sheet, which has been held by the folding cylinder, in a plurality of positions in the circumferential direction;

one second jaw cylinder, which is opposed to, and in contact with, the first jaw cylinder, which includes gripping-holding means for holding the sheet in a plurality of positions in the circumferential direction, and which is rotatably supported;

the other second jaw cylinder, which is opposed to, and in contact with, the first jaw cylinder, which includes gripping-holding means for holding the sheet, and which is rotatably supported; and switching means, which switches the delivery channels in a way that, after the gripping-holding means are caused to operate in a position making the folding cylinder and the first jaw cylinder opposed to, and in contact with, each other, as well as after accordingly the first jaw cylinder is caused to hold the sheet thus transferred, the sheet is transferred from the gripping-holding means of the first jaw cylinder to any one of only the gripping-holding means of the former second jaw cylinder as well as the gripping-holding means of the former second jaw cylinder and the gripping-holding means of the latter second jaw cylinder, and which concurrently performs the switching of the folding specifications from the first jaw cylinder to at least any one of the former second jaw cylinder and the latter second jaw cylinder in each of the delivery channels, wherein the gripping-holding means of the first jaw cylinder include first gripping-holding means for supporting a first cam follower and second gripping-holding means for supporting a second cam follower;

the switching means includes a gripper closing cam fixed to a frame, and a gripper opening cam for a first application and a gripper opening cam for a second application, both of which are supported so as to be movable relative to the frame;

the first gripping-holding means operate in cooperation with the gripper closing cam, the gripper opening cam for the first application, and the first cam follower; and the second gripping-holding means operate in cooperation with the gripper closing cam, the gripper opening cam for the second application and the second cam follower.

7. The parallel folding device of a folding machine according to claim 6, further comprising:

first drive means for rotating the gripper opening cam for the second application; and second drive means for rotating the gripper opening cam for the first application and the gripper opening cam for the second application.

8. The parallel folding device of a folding machine according to claim 7, wherein:

the gripper opening cam for the first application is fixed to a rotating member;

the gripper opening cam for the second application is caused, by the first drive means, to move between a position where the sheet is transferred from the first jaw cylinder to the former second jaw cylinder and a position where the sheet is transferred from the first jaw cylinder to the latter second jaw cylinder;

the first drive means is supported by a supporting member;

the supporting member is fixed to the rotating member; and the rotating member is rotated by the second drive means.

9. The parallel folding device of a folding machine according to claim 7, wherein the delivery channels are switched by means of the first drive means.

10. The parallel folding device of a folding machine according to claim 7, wherein the folding specifications are switched by means of the second drive means.

11. The parallel folding device of a folding machine according to claim 8, wherein the second drive means are constituted in a way that two pneumatic cylinders are linked to each other with a bellcrank.

12. The parallel folding device of a folding machine according to claim 8, further comprising:

a first stopper for checking a position of the rotating member when the first stopper comes to abut on the rotating member;

a second stopper for checking a position of the rotating member when the second stopper comes to abut on the rotating member; and a third stopper, which is provided in a way that the third stopper can be caused to protrude and subside by a third drive means, and which checks the position of the rotating member between the first stopper and the second stopper when the third stopper comes to abut on the rotating member while being protruding.

13. The parallel folding device of a folding machine according to claim 12, further comprising:

control means for controlling drives respectively of the first drive means, the second drive means and the third drive means, on the basis of at least any one of the folding specifications, which are inputted through the folding-specifications inputting part, and the delivery channels, which are inputted through the delivery inputting part.

* * * * *